US006679159B1

(12) United States Patent
Hullett

(10) Patent No.: US 6,679,159 B1
(45) Date of Patent: Jan. 20, 2004

(54) AMMUNITION TRANSFER SYSTEM

(75) Inventor: Christopher L. Hullett, St. Louis Park, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 10/285,306

(22) Filed: Oct. 31, 2002

(51) Int. Cl.[7] ..... F41A 9/00
(52) U.S. Cl. ..... 89/45; 89/46
(58) Field of Search ..... 89/45, 46, 47, 89/33.05, 33.01

(56) References Cited

U.S. PATENT DOCUMENTS

| | | | | |
|---|---|---|---|---|
| 3,122,967 A | | 3/1964 | Johnson et al. | 89/45 |
| 3,218,930 A | | 11/1965 | Girouard et al. | 89/45 |
| 3,724,324 A | | 4/1973 | Zielinski | 89/36 |
| 4,092,900 A | | 6/1978 | Hottinger et al. | 89/33 |
| 4,313,363 A | | 2/1982 | Schreckenberg | 89/46 |
| 4,398,447 A | | 8/1983 | Harris et al. | 89/46 |
| 4,401,008 A | | 8/1983 | Walker, Jr. | 89/33 |
| 4,429,616 A | | 2/1984 | Grosser | 89/36 |
| 4,457,209 A | | 7/1984 | Scheurich et al. | 89/45 |
| 4,481,862 A | | 11/1984 | Wiethoff et al. | 89/46 |
| 4,706,544 A | * | 11/1987 | Zielinski et al. | 89/46 |
| 4,730,536 A | | 3/1988 | Nordmann | 89/45 |
| 4,763,559 A | * | 8/1988 | Bouillon | 89/33.04 |
| 4,838,144 A | | 6/1989 | Bierwirth et al. | 89/45 |
| 4,947,728 A | * | 8/1990 | Muhlhausen et al. | 89/46 |
| 5,773,747 A | | 6/1998 | Tellander et al. | 89/47 |
| 5,811,721 A | | 9/1998 | Anderson et al. | 89/45 |
| 5,880,395 A | | 3/1999 | Krumm et al. | 89/46 |
| 6,279,450 B1 | * | 8/2001 | Schmees | 89/45 |
| 6,591,733 B1 | * | 7/2003 | Engstrom | 89/45 |

* cited by examiner

*Primary Examiner*—J. Woodrow Eldred
(74) *Attorney, Agent, or Firm*—Patterson, Thuente, Skaar & Christensen, P.A.

(57) ABSTRACT

An ammunition transfer system and method of loading a weapon wherein the rate of ammunition transfer and the consequent rate of fire of the weapon is independent of the azimuth angle of the weapon. In a preferred embodiment, the invention includes a multiple cell ammunition cradle system for a weapon having a carriage and a barrel. The system includes at least one ammunition hoist and a cradle operably coupled to the carriage. The cradle is selectively positionable in a charging position and a loading position. The cradle has a carrier, which may be a rotor with a plurality of cells, each cell adapted to receive an ammunition round. The rotor is rotatable about a rotor axis, and is controllably positionable so that each cell is selectively alignable with the ammunition hoist when the cradle is positioned in the charging position and so that each cell is selectively alignable with the barrel when the cradle is positioned in the loading position. The ammunition transfer system of the present invention is suitable for handling any type of ammunition including separate, semi-fixed, or fixed ammunition, and may also be used to handle rocket propelled or precision guided munitions. It is anticipated that the ammunition handling system, when used with a major caliber gun, may allow firing rates of ten rounds per minute and more.

22 Claims, 5 Drawing Sheets

AMMUNITION TRANSFER SYSTEM

FIELD OF THE INVENTION

This invention pertains to systems for transferring ammunition for weapons, and more specifically, it pertains to ammunition transfer systems for weapons mounted on carriages.

BACKGROUND OF THE INVENTION

Ships have been used as weapons platforms for centuries. In modern times, warships mounting major caliber guns are often used for heavy bombardment of targets on shore. The emphasis on design of warships in the past has often focused on mounting a relatively large number of guns on a single platform due to the high cost involved with building large ships with the capability of supporting even one major caliber weapon. It was possible for such a ship to maintain a high rate of fire overall due to the large number of weapons.

Warships of today are often used to support limited engagements in which it is necessary for the weapons to have pinpoint accuracy in order to minimize collateral damage to non-military targets, and to provide close fire support for troops on the ground. Due to the relatively high cost of weapons with the desired degree of accuracy, it is desirable to develop weapons with a high rate of fire so as to minimize the need for large numbers on a single platform.

Ammunition rounds for major caliber weapons normally comprise a projectile round, a propellant charge round and a primer round or other igniting means. Separate ammunition is a term that refers to systems in which the three rounds are separately provided and are combined at the weapon. The term semi-fixed ammunition refers to systems in which the primer and the propellant are packaged together, and the term fixed ammunition refers to systems in which all three rounds are packaged together. Ammunition rounds for major caliber guns are normally of the separate or semi-fixed ammunition type. In addition, other weapons may use ammunition rounds in the form of torpedoes, rockets or other precision guided munitions, either in a single package or as separate rounds. For the purposes of this application, the term ammunition round is used interchangeably to refer to complete ammunition rounds as well as any separate portion thereof.

Weapons are usually mounted in turrets or carriages on a warship, and the tube or barrel of the weapon is generally controllable in elevation as well as in azimuth, referred to as train. The term elevation axis refers to the axis about which the weapon rotates in elevation, and the term train axis refers to the axis about which the weapon rotates in azimuth. Ammunition rounds are normally supplied to the carriages from magazines located deep in the hull through one or more ammunition handling systems. Such ammunition handling systems are well known.

Examples of previous ammunition handling systems are described in U.S. Pat. No. 3,218,930 to Girouard, et. al., U.S. Pat. No. 3,122,967 to Johnson, et. al., U.S. Pat. No. 4,457,209 to Scheurich et al., and U.S. Pat. No. 4,481,862 to Wiethoff, et. al., each of which is hereby fully incorporated herein by reference. In each of these systems, ammunition is supplied to the gun by a method known in the art as "off-axis loading", meaning that the ammunition rounds are supplied vertically to the carriage with a hoist located along an axis offset from the train axis of the gun.

A simplified diagram of a common type of off-axis loading system is depicted in FIG. 7. Off-axis loading is desirable in part because it allows a system to use multiple hoists and multiple gun cradles, thereby improving the rate of fire from that achievable with an on-axis loading system. Since the azimuth of the gun breech and cradle varies with the azimuth of the weapon in an off-axis loading system, however, a complex mechanism is required to receive the ammunition round from the off-axis hoist, transfer it the distance from the hoist to the cradle of the weapon, and align it with the breech so it can be loaded into the weapon. The necessity to "follow" the train motion of the weapon makes the firing rate of the weapon dependant on the azimuth of the weapon, and thus can cause a significant negative impact on the rate of fire at certain azimuths.

What is needed is an off-axis loading type ammunition transfer system that enables a constant rate of fire at all weapon azimuths.

SUMMARY OF THE INVENTION

The present invention includes an ammunition transfer system for an off-axis loaded weapon, wherein the rate of ammunition transfer and the consequent rate of fire of the weapon is independent of the azimuth angle of the weapon. The benefits of off-axis loading are accordingly provided, without the degradation of the weapon rate of fire at certain weapon azimuths. In a preferred embodiment, the invention is a carrier assembly having a rotor with a plurality of ammunition cells formed therein. Each of the ammunition cells is alignable with the train axis of the weapon so that an ammunition round may be loaded into the cell, and is also alignable with a transfer axis that is off-set from the train axis. A pivoting cradle is also provided which can be aligned with the transfer axis. When the ammunition cell containing an ammunition round is aligned with the transfer axis and the cradle is also aligned with the transfer axis, the ammunition round may be transferred from the ammunition cell to the cradle. The cradle may then be swung into position proximate the breech of the weapon, the ammunition round rammed into the breech, and the weapon fired. The ammunition transfer system of the present invention is suitable for handling any type of ammunition including separate, semi-fixed, or fixed ammunition, and may also be used to handle rocket propelled or precision guided munitions. It is anticipated that the ammunition handling system of the present invention, when used with a major caliber gun, may enable firing rates of ten rounds per minute and more.

Thus, the invention may be characterized in one embodiment as an ammunition transfer system for a weapon having a carriage. The system comprises an ammunition hoist positioned along a charging axis, a cradle operably coupled to the carriage and capable of being positioned along a transfer axis, and a carrier operably coupled to the carriage. The carrier has at least one cell adapted to receive an ammunition round. The cell is controllably alternately positionable along the charging axis to receive the ammunition round and along the transfer axis to discharge the ammunition round to the cradle.

The invention may also be characterized as method for loading a weapon, the weapon being rotatable on a carriage. The method may comprise first providing ammunition transfer system comprising an ammunition hoist disposed along a charging axis, a cradle operably coupled to the carrier and capable of being positioned along a transfer axis, and a carrier fixed to the carriage, the carrier having at least one cell adapted to receive an ammunition round. The cell is selectively alternately positionable along the charging axis to receive an ammunition round and the transfer axis to discharge the ammunition round to the cradle. The method also includes the steps of positioning the carrier so that the cell is aligned with the charging axis, loading an ammunition round in the cell, positioning the carrier so that the cell is aligned with the transfer axis, positioning the cradle along the transfer axis, and transferring the ammunition round from the cell to the cradle along the transfer axis.

The invention may also be characterized as a weapon with an ammunition handling system. The weapon comprises a carriage, a barrel mounted on the carriage and positioned along a loading axis, an ammunition hoist positioned along a charging axis, a cradle operably coupled to the carriage and capable of being positioned along a transfer axis and along the charging axis, and a carrier attached to the carriage and having a plurality of ammunition cells adapted to receive an ammunition round. Each of the plurality of ammunition cells is positionable along the charging axis to receive the ammunition round and along the transfer axis to discharge the ammunition round into the cradle.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
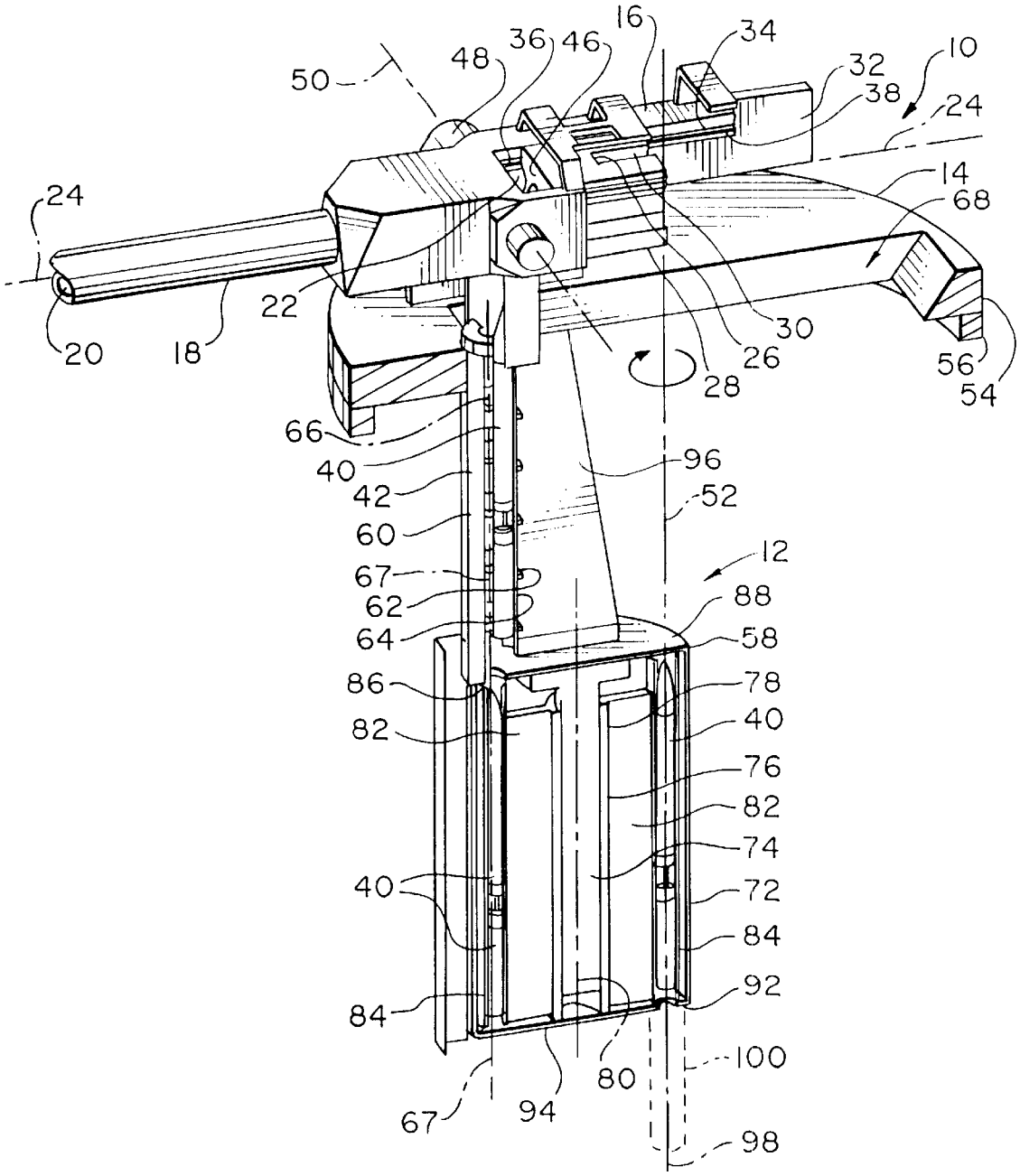
FIG. 1 is a cut-away perspective view of the ammunition transfer system of the present invention with a weapon.
Figure 2:
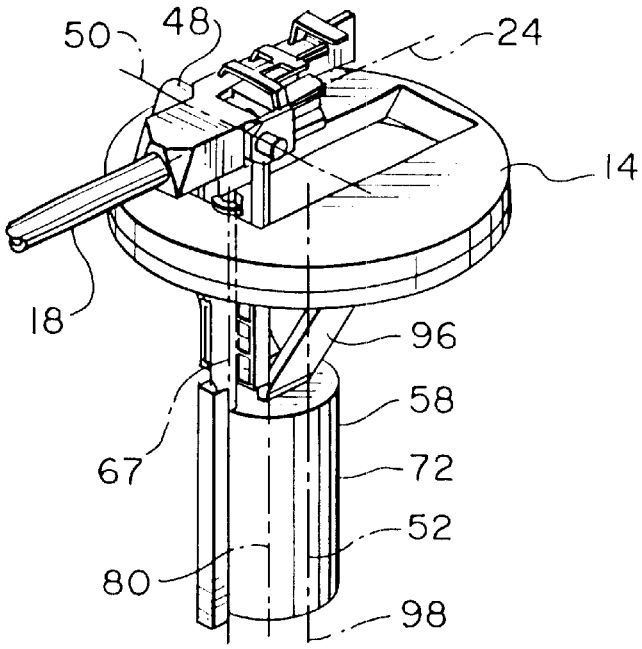
FIG. 2 is a perspective view of the ammunition transfer system of the present invention.
Figure 3:
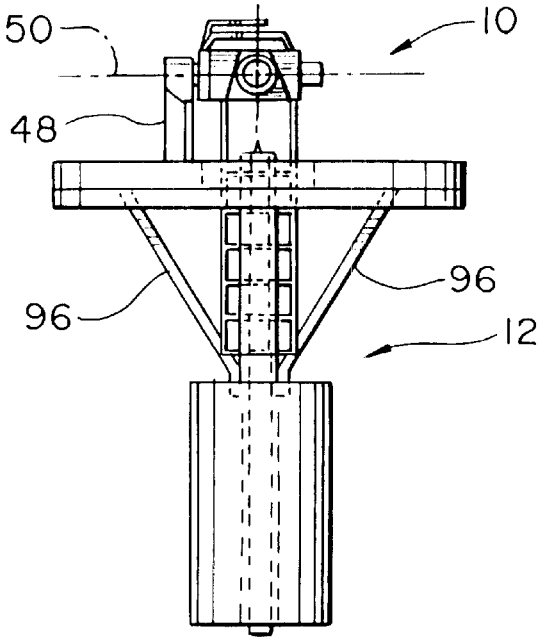
FIG. 3 is a front elevation of the ammunition transfer system.
Figure 4:
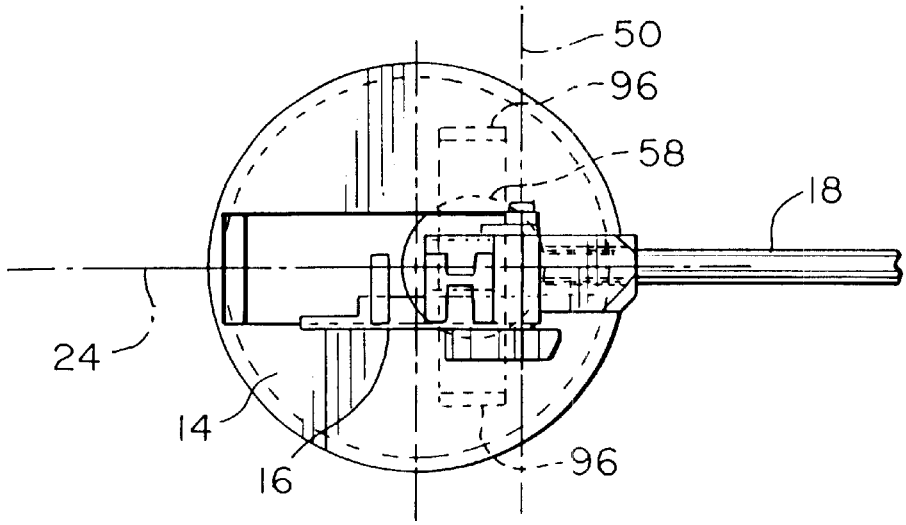
FIG. 4 is a top plan view of the weapon and ammunition transfer system.
Figure 5:
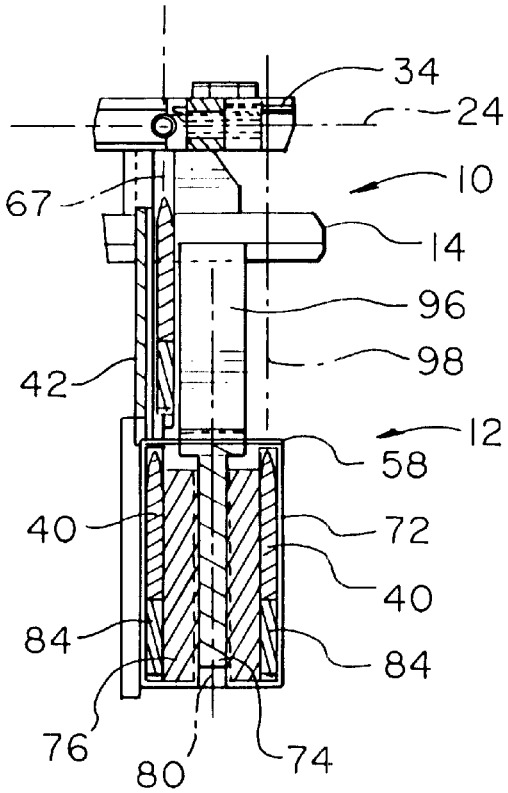
FIG. 5 is a side sectional view of the weapon and ammunition transfer system.

FIG. 1 shows a weapon 10 and an embodiment of the ammunition transfer system 12 of the present invention. Weapon 10, depicted as a major caliber gun, generally includes carriage 14, elevating structure 16, and barrel 18. Barrel 18 has a bore 20, and a firing chamber 22, both presenting loading axis 24. Elevating structure 16 has breech portion 26, which generally includes gun barrel housing 28 and breech block 30. Gun barrel housing 28 is supported by slide 32, which is slidingly mounted in guides 34. Slide 32 is movable in a reciprocating fashion between proximal end 36 and distal end 38 of guides 34. Breech block 30 may be positioned at defined proximal and distal locations that close or open, respectively, firing chamber 22. When gun barrel housing 28 is positioned at proximal end 36 of guides 34, an ammunition round 40 disposed in cradle 42 may be interposed in axial alignment with loading axis 24 behind gun barrel housing 28 and in front of distal end 46 of breech block 30. Ammunition round 40 may then be rammed into firing chamber 22. Proximal movement of breech block 30 rams the round and closes firing chamber 22, enabling the weapon to be fired.

Elevating structure 16 is pivotably mounted on trunnion supports 48, which bear on carriage 14. Trunnion supports 48 enable rotation of elevating structure 16 about elevation axis 50, thereby enabling barrel 18 to be elevated to any desired angle. Carriage 14 is mounted for rotational movement about train axis 52 so as to enable weapon 10 to be trained at any desired azimuth angle. The periphery 54 of carriage 14 bears upon a corresponding bearing assembly 56 mounted on the ship structure to enable the rotational movement.

Ammunition transfer system 12 generally includes cradle 42 and carrier assembly 58. Cradle 42 includes lower support portion 60 and upper guide portion 62, which together define a cylindrical enclosure 64 for ammunition round 40. The cylindrical enclosure 64 presents a longitudinal axis 66. Cradle 42 is pivotably mounted about elevation axis 50. Cradle 42 may be positioned in the upright, transfer position depicted in FIG. 1, wherein cradle 42 presents a transfer axis 67, co-axial with longitudinal axis 66. Cradle 42 may be pivoted through carriage opening 68, to a loading position wherein longitudinal axis 66 of cradle 42 aligns with loading axis 24 of bore 20.

Carrier assembly 58 generally includes casing portion 72, shaft 74, and rotor 76. Rotor 76 has a central hub portion 78, which is rotationally mounted on shaft 74 about carrier axis 80. Lobe portions 82 extend radially outward from hub portion 78. A single ammunition cell 84 is disposed at the end of each lobe portion 82. As depicted in FIG. 1, rotor 76 has two directly opposed ammunition cells 84, disposed 180 rotational degrees apart. With each 180 degrees of rotation of rotor 76, each ammunition cell 84 is alternatively positioned in alignment with top opening 86 in top 88 of casing portion 72, or in alignment with bottom opening 92 in bottom 94 of casing portion 72.

The top 88 of carrier assembly 58 is fixed to one end of beam 96. The other end of beam 96 is fixed to the underside of carriage 14. Carrier assembly 58 is positioned and dimensioned so that bottom opening 92 is aligned with a charging axis 98 presented by a vertical ammunition hoist 100. Charging axis 98 of hoist 100 is coaxial with train axis 52 of the weapon 10. Carrier assembly 58 rotates with carriage 14, and as a result, bottom opening 92 of casing portion 72 is constantly aligned with train axis 52 and the charging axis 98 of ammunition hoist 100, regardless of the azimuthal position of weapon 10.

Top opening 86 is positioned so as to align with transfer axis 67 presented by cradle 42 when the cradle is disposed in the transfer position as depicted in FIG. 1. Because carrier assembly 58 rotates with carriage 14, top opening 86 is maintained in a fixed relationship relative to cradle 42, and transfer axis 67 is always aligned with top opening 86 whenever cradle 42 is positioned in the transfer position, regardless of the azimuthal position of the weapon 10.

Rotor 76 is equipped with a power actuator, such as an electric or hydraulic motor, and is positionable in each of two rotational positions 180 degrees apart, so that each ammunition cell 84 is alternately aligned with top opening 86 or bottom opening 92. In operation, an ammunition round 40 is vertically lifted from ammunition hoist 100 through bottom opening 92 along charging axis 98, and is received by the aligned ammunition cell 84. Cradle 42 is positioned in the transfer position as depicted in FIG. 1, presenting transfer axis 67. Rotor 76 is then rotated 180 degrees so that the same ammunition cell 84 is aligned with top opening 86 and transfer axis 67. Ammunition round 40 is then lifted upward through top opening 86 and is received in the cylindrical enclosure 64 of cradle 42. Cradle 42 is then pivoted upward about elevation axis 50 so that longitudinal axis 66 of cradle 42 is coaxial with loading axis 24 of bore 20. Proximal movement of breech block 30 then rams the ammunition round into firing chamber 22, thus readying the weapon for firing.

Although rotor 76 has two ammunition cells 84 in the embodiment depicted in FIG. 1, any number of ammunition cells may be provided so long as each ammunition cell can be selectively aligned with charging axis 98 and transfer axis 67 as described. For example, four ammunition cells may be disposed 90 degrees apart on rotor 76 with four selectable rotational positions.

The present invention enables off axis loading of weapon 10 with a fixed sequence of movements that is not dependant on the relative azimuth of the weapon 10. Because rounds can be fired as quickly as they can be transferred into cradle 42, the cradle pivoted into position, the round rammed into the firing chamber 22, and the gun fired, uniformly high rates of fire may be achieved. It is anticipated that rates of fire of 10 or more rounds per minute are achievable with the invention.

With suitable apparatus to arrange separate components as they are placed in the ammunition hoist, the ammunition transfer system of the present invention may used to handle any type of ammunition round, whether fixed, semi-fixed or separate. The ammunition transfer system may also be used to handle rocket propelled and precision guided munitions. Although weapon 10 is depicted here as a major caliber gun, it is contemplated that the present invention may be usable with all types of weapons. For example, barrel 18 may be a barrel as depicted, a torpedo tube, a rocket launcher cell and rail assembly, or other type of firing or launching element having a similar function. Thus, in a weapon wherein such other type of element is used to fire, guide or launch a munition, missile, projectile, bomb, or other weapon, such element shall be deemed to define a barrel.

Figure 6:
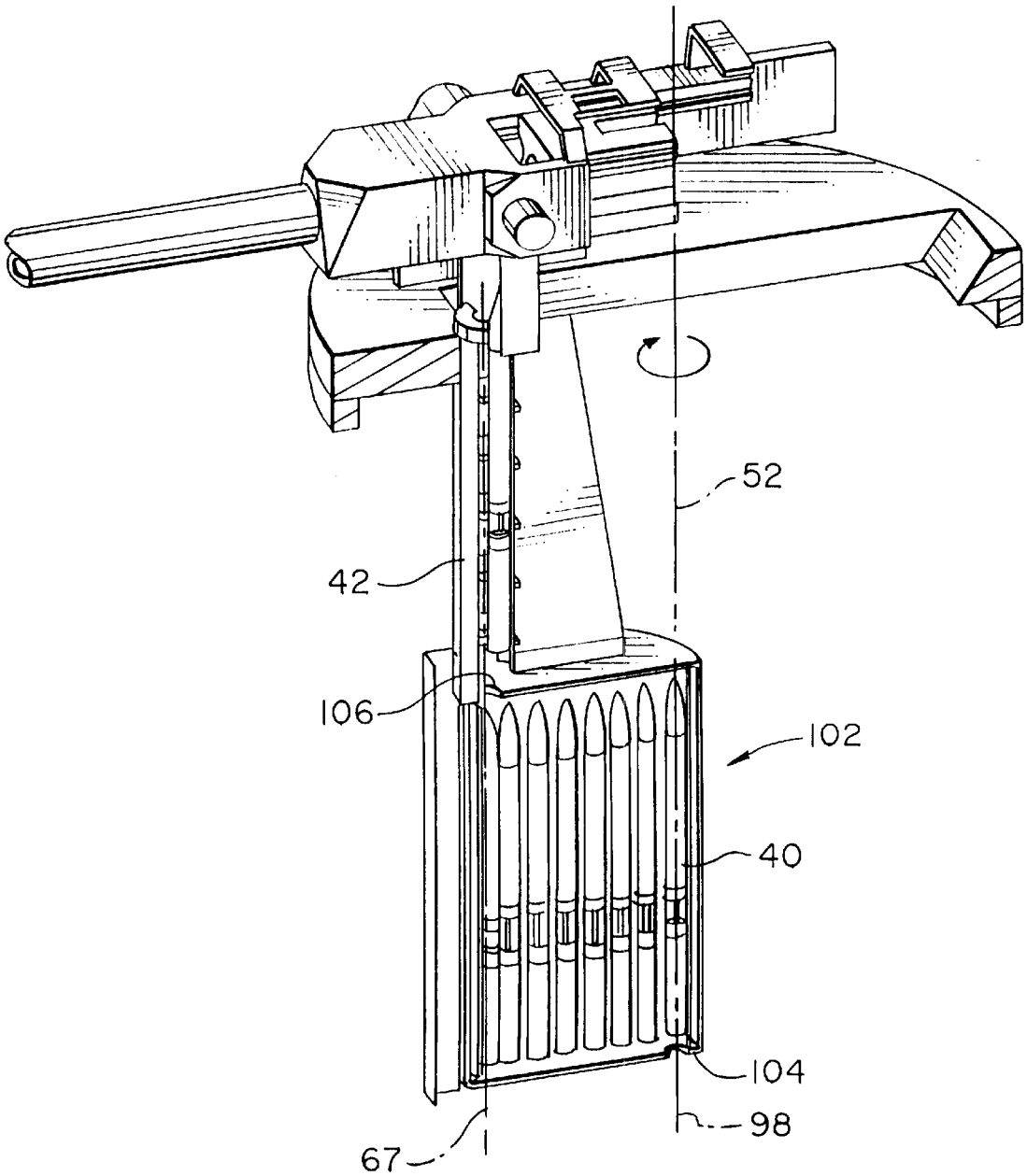
FIG. 6 is a partial sectional view of an alternative embodiment of the ammunition transfer system of the present invention.
Figure 7:
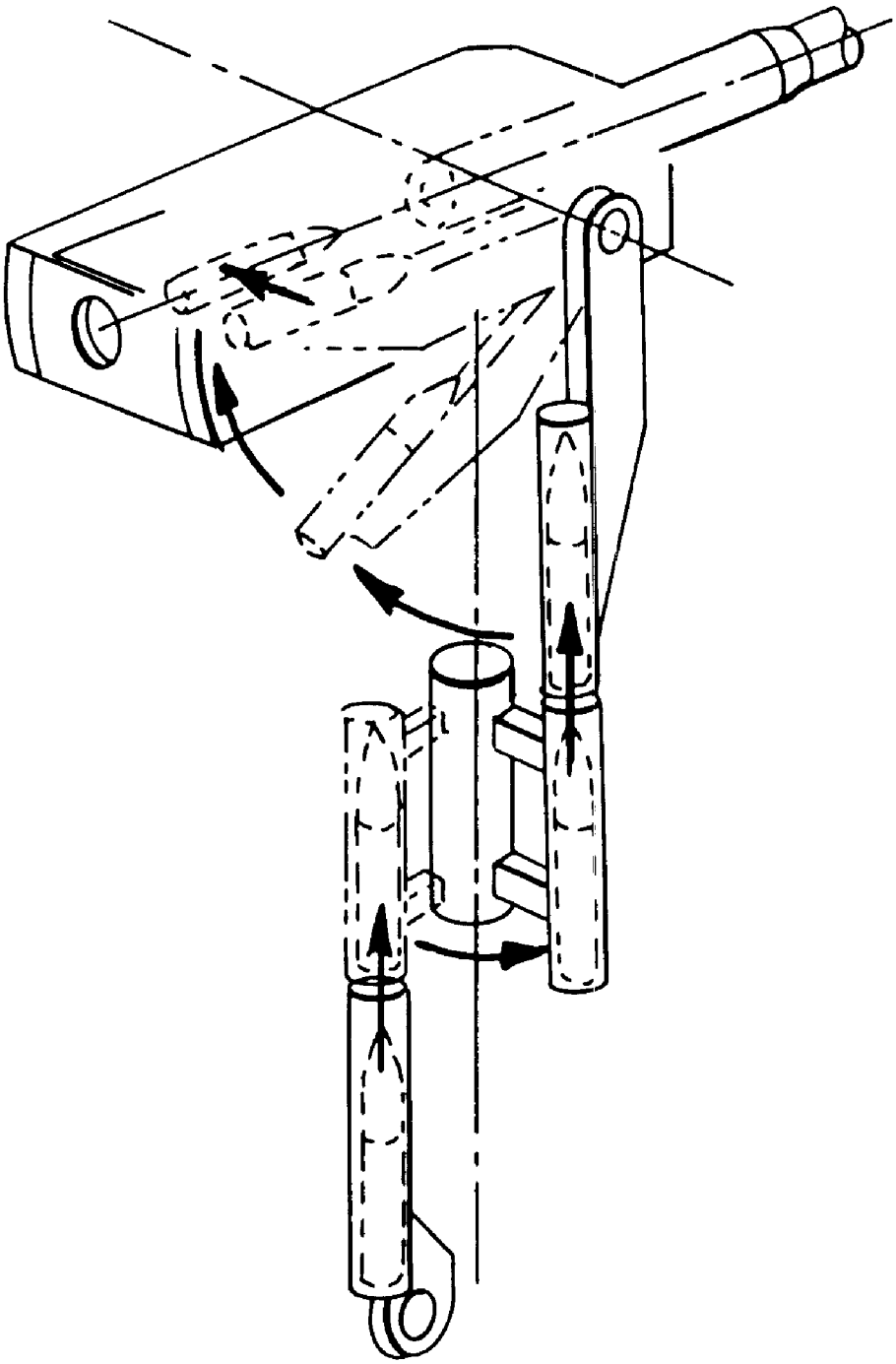
Fig. 7 PRIOR ART
FIG. 7 is a partial, perspective view of a prior art off-axis loading system.

FIG. 6 depicts an alternative embodiment of the ammunition transfer system of the present invention. The rotary carrier assembly of the embodiments described above has been replaced with linear carrier assembly 102. In this embodiment, as ammunition rounds 40 are loaded through bottom opening 104, they are captured by a suitable conveyor assembly and conveyed in the direction of cradle opening 106. The conveyor assembly may be any known conveyor assembly suitable for the purpose such as, for example, that disclosed in U.S. Pat. No. 4,092,900, a copy of which is fully incorporated herein by reference. Ammunition rounds 40 may then be loaded into cradle 42 through cradle opening 106 as before.

Although the description above contains many specificities, these should not be construed as limiting the scope of the invention but as merely providing illustrations of some of the presently preferred embodiments of the invention. Thus, the scope of the invention should be determined by the appended claims and their legal equivalents, rather than by the examples given.

What is claimed is:

1. An ammunition transfer system for a weapon, the weapon having a carriage and a barrel, the system comprising:

an ammunition hoist presenting a charging axis;

a cradle operably coupled to the carriage and positionable in a transfer position and a loading position, said cradle presenting a transfer axis when positioned in said transfer position; and a carrier operably coupled to the carriage and having a plurality of ammunition cells adapted to receive an ammunition round, each of said plurality of ammunition cells being positionable in substantial axial alignment with the charging axis to receive the ammunition round and in substantial axial alignment with the transfer axis to discharge the ammunition round into said cradle.

2. The ammunition transfer system of claim 1, wherein the ammunition round is a fixed round, a projectile, a propellant package, a primer, or a propellant/primer package.

3. The ammunition transfer system of claim 1, wherein said barrel presents a loading axis, and wherein said cradle is positioned in substantial axial alignment with the loading axis when said cradle is positioned in said loading position.

4. An ammunition transfer system for a weapon having a carriage, the system comprising:

an ammunition hoist presenting a charging axis;

a cradle operably coupled to the carriage and positionable in a transfer position and a loading position, said cradle presenting a transfer axis when positioned in said transfer position; and a carrier operably coupled to the carriage and having at least one cell adapted to receive an ammunition round, said at least one cell controllably alternately positionable along the charging axis to receive the ammunition round and along the transfer axis to discharge the ammunition round to said cradle.

5. The ammunition transfer system of claim 4, wherein the ammunition round is a fixed round, a projectile, a propellant package, a primer, or a propellant/primer package.

6. The ammunition transfer system of claim 5, wherein said weapon has a barrel presenting a loading axis, and wherein said cradle is aligned with the loading axis when positioned in the loading position.

7. An ammunition transfer system for a weapon having a carriage, the system comprising:

an ammunition hoist presenting a charging axis;

a cradle operably coupled to the carriage and positionable in a transfer position and a loading position, said cradle presenting a transfer axis when positioned in said transfer position, said transfer axis being offset and oriented substantially parallel with the charging axis; and means for transferring an ammunition round from said ammunition hoist to said cradle.

8. The ammunition transfer system of claim 7, wherein said means for transferring an ammunition round from said ammunition hoist to said cradle comprises a carrier having at least one cell adapted to receive an ammunition round, said at least one cell being positionable along the charging axis to receive an ammunition round and along the transfer axis to discharge said ammunition round to the cradle.

9. The ammunition transfer system of claim 8, wherein said carrier has a plurality of cells, each adapted to receive an ammunition round.

10. The ammunition transfer system of claim 7, wherein said means for transferring an ammunition round from said ammunition hoist to said cradle comprises a linear conveyor.

11. The ammunition transfer system of claim 7, wherein the ammunition round is a fixed round, a projectile, a propellant package, a primer, or a propellant/primer package.

12. The ammunition transfer system of claim 10, wherein said weapon has a barrel presenting a loading axis, and wherein said cradle is aligned with the loading axis when positioned in said loading position.

13. A method for loading a weapon, the weapon being rotatable on a carriage, the method comprising the steps of:

providing an ammunition transfer system comprising an ammunition hoist presenting a charging axis, a cradle operably coupled to the carrier and presenting a transfer axis, and a carrier fixed to the carriage, said carrier having at least one cell adapted to receive an ammunition round, said at least one cell selectively alternately positionable along the charging axis to receive an ammunition round and the transfer axis to discharge the ammunition round to said cradle;

positioning the carrier so that said at least one cell is aligned with the charging axis and loading an ammunition round in said at least one cell along the charging axis;

positioning the carrier so that said at least one cell is aligned with the transfer axis;

positioning said cradle along the transfer axis; and transferring said ammunition round from said at least one cell to said cradle along the transfer axis.

14. The method of claim 13, wherein said weapon has a barrel presenting a loading axis, wherein said cradle aligned with the loading axis when positioned in said loading position, and wherein the method further comprises the step of positioning said cradle in the loading position.

15. An apparatus for transferring an ammunition round from an ammunition hoist to a cradle of a weapon mounted on a carriage, the ammunition hoist presenting a charging axis, the cradle presenting a transfer axis, the apparatus comprising a carrier assembly rotationally fixed with respect to the carriage, said carrier assembly having at least one ammunition cell selectively operably positionable in alignment with the charging axis to receive the ammunition round, and in alignment with the transfer axis to discharge the ammunition round to the cradle.

16. The apparatus of claim 15, wherein said carrier assembly comprises a rotor selectively rotatable about a carrier axis, said at least one ammunition cell being formed in said rotor.

17. The apparatus of claim 15, wherein said carrier assembly comprises a linear conveyor.

18. A weapon with ammunition handling system comprising:

a carriage;

a barrel mounted on the carriage and presenting a loading axis;

an ammunition hoist presenting a charging axis;

a cradle operably coupled to the carriage and capable of being positioned in a transfer position and a loading position, said cradle presenting a transfer axis when positioned in said transfer position; and a carrier attached to the carriage and having a plurality of ammunition cells adapted to receive an ammunition round, each of said plurality of ammunition cells being positionable along the charging axis to receive the ammunition round and along the transfer axis to discharge the ammunition round into said cradle.

19. The weapon and ammunition handling system of claim 18, wherein the ammunition round is a fixed round, a projectile, a propellant package, a primer, or a propellant/primer package.

20. The weapon and ammunition handling system of claim 18, wherein said cradle is aligned with the loading axis when positioned in said loading position.

21. A method for transferring ammunition to a weapon comprising the steps of:

providing means for transferring an ammunition round from an ammunition hoist presenting a charging axis to a movable cradle presenting a transfer axis, said means having at least one ammunition cell presenting a longitudinal axis;

aligning said longitudinal axis of said ammunition cell with said charging axis;

lifting the round from said ammunition hoist into said ammunition cell;

aligning said longitudinal axis of said ammunition cell with said transfer axis; and lifting the round into said pivotable cradle.

22. The method of claim 21, wherein said weapon has a firing chamber and a barrel with a bore, said bore presenting a loading axis, and wherein the method further comprises the steps of positioning said cradle with the longitudinal axis in alignment with the loading axis, and ramming the round into said firing chamber.

* * * * *